US006293168B1

(12) United States Patent
Torlai et al.

(10) Patent No.: US 6,293,168 B1
(45) Date of Patent: Sep. 25, 2001

(54) STAMPED ROCKER ARMS FOR MACHINES SUCH AS INTERNAL COMBUSTION ENGINES

(75) Inventors: David R. Torlai, Torrington, CT (US); Eric Hanniger, Madison, AL (US)

(73) Assignee: The Torrington Company, Torrington, CT (US)

( * ) Notice: Subject to any disclaimer, the term of this patent is extended or adjusted under 35 U.S.C. 154(b) by 0 days.

(21) Appl. No.: 09/413,160

(22) Filed: Oct. 6, 1999

(51) Int. Cl.[7] ..... F01L 1/18
(52) U.S. Cl. ..... 74/559; 123/90.41
(58) Field of Search ..... 74/569, 559, 519; 123/90.39, 90.41; 248/903, 62, 221.12, 221.41, 223.21

(56) References Cited

U.S. PATENT DOCUMENTS

| | | | | |
|---|---|---|---|---|
| 2,338,726 | | 1/1944 | Leake . | |
| 3,096,749 | | 7/1963 | Davidson . | |
| 3,270,725 | * | 9/1966 | Thompson | 74/519 |
| 4,430,783 | * | 2/1984 | Wherry | 29/156.4 R |
| 4,825,717 | | 5/1989 | Mills . | |
| 4,829,647 | | 5/1989 | Anderson et al. . | |
| 5,010,857 | | 4/1991 | Hemplemann et al. . | |
| 5,207,191 | * | 5/1993 | Pryba et al. | 123/90.39 |
| 5,251,585 | | 10/1993 | Graber . | |
| 5,297,509 | | 3/1994 | Murphy . | |
| 5,329,891 | | 7/1994 | Murphy et al. . | |
| 5,535,641 | * | 7/1996 | Uchida et al. | 74/559 |
| 5,671,707 | * | 9/1997 | Purcell et al. | 123/90.37 |
| 5,678,305 | | 10/1997 | Nagano et al. . | |
| 5,720,245 | | 2/1998 | Calka . | |
| 5,836,557 | * | 11/1998 | Bailey et al. | 248/210 |

FOREIGN PATENT DOCUMENTS

| | | | | |
|---|---|---|---|---|
| 504372 | * | 7/1954 | (CA) | 74/559 |

* cited by examiner

*Primary Examiner*—Mary Ann Green
(74) *Attorney, Agent, or Firm*—John C. Bigler; Robert F. Palermo

(57) ABSTRACT

A rocker arm, for operating a valve in a machine such as an internal combustion engine, has a stamped body with a push rod socket at a first end, a valve pallet at a second end, and two lateral walls extending between the first and second ends, each of the lateral walls having a bearing support aligned on a common axis. A stiffener strap extends from one bearing support over the lateral walls to the other bearing support, the stiffener strap having a bearing housing at each end for engagement with the bearing supports of the stamped body. The stiffener strap may also include stabilizer features for clamping the lateral walls of the stamped body to resist inward buckling in service.

3 Claims, 1 Drawing Sheet

STAMPED ROCKER ARMS FOR MACHINES SUCH AS INTERNAL COMBUSTION ENGINES

BACKGROUND OF THE INVENTION

This invention relates generally to rocker arms for operating valves in internal combustion engines and other machines and more particularly to individually mounted stamped steel rocker arms with anti-friction pivot bearings.

In the past, rocker arms for transmitting camshaft motion to valves in machinery consisted of arms pivoted on a shaft which was mounted on studs projecting from the cylinder head in which the valves were installed. The quest for increased efficiency and weight reduction, especially in internal combustion engines, led to introduction of individually mounted rocker arms.

Most individually mounted rocker arms consist of a rocker arm with an axial pivot body which is mounted on the engine with a bolt or other fastener. The pivot body supports bearings on a pivot axis on which the rocker arm is pivoted. The rocker arm has bearing support areas which are thickened wall areas surrounding the pivot axis of the rocker arm. The rocker arms are usually made from investment castings which are very strong and generally of high quality, although they are quite heavy and costly.

Efforts to reduce engine weight and cost have led engine manufacturers to attempt to make rocker arms from thin steel stampings. Such rocker arms provide lower weight and cost, but they introduce other difficulties not encountered with cast counterparts. Since there are some tight radii and deep draws necessary in light weight stamped rocker arms, it is necessary to use the thinnest material possible for such stampings. The benefits of easier forming and lower weight obtained by use of the thin material are offset by the decreased rigidity of the formed body and the severely reduced bearing support areas in the formed walls of the rocker arm. The bearing support area is critical; because if it becomes too small, the bearings may fall out or become misaligned, either of which would be catastrophic to the machine or engine. However, if the material is thickened enough to provide equivalent bearing support area to that achieved in cast rockers, forming difficulty is increased by a greater-than-linear factor, and any weight reduction advantage is diminished or completely lost. Some improvement has been achieved in bearing support housings of stamped rocker arms by extruding such housings in the walls of the rocker arm. Although more difficult and costly to make than rocker arms without extruded supports, such rocker arms provide improved bearing support over that obtained without extrusion.

Even with the bearing support problem solved, stamped rocker arms, when compared to cast rocker arms, have significantly lower strength and endurance. Because they do not have the gussets and other cast-in reinforcements of castings, stamped rocker arms have no lateral support for the free edges of their sidewalls. Thus, if they are stamped from material thin enough to provide very great weight reduction, they are subject to buckling under compressive loading of the upper lateral walls in service. They may also experience bearing walk resulting from such buckling, which causes the bearing support areas, even those with extruded bearing housings, of the rocker arm to become misaligned with the pivot axis. This presents the dilemma in which lightweighting is desired but is limited by bearing support considerations and compressive rigidity. Formability, on the other hand, dictates using the thinnest material possible in order to permit severe forming strains.

The foregoing illustrates limitations known to exist in present stamped steel rocker arms. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rocker arm, for operating a valve, comprising a stamped body having a push rod socket at a first end, a valve pallet at a second end, and two lateral walls extending between said first and second ends, each of said lateral walls having a bearing support aligned on a common pivot axis; and a stiffener strap extending from one bearing support over said lateral walls to the other bearing support, said stiffener strap having bearing housings at each end for engagement with said bearing supports.

The foregoing and other aspects will become apparent from the following detailed description of the invention when considered in conjunction with the accompanying drawings.

DETAILED DESCRIPTION

Figure 1:
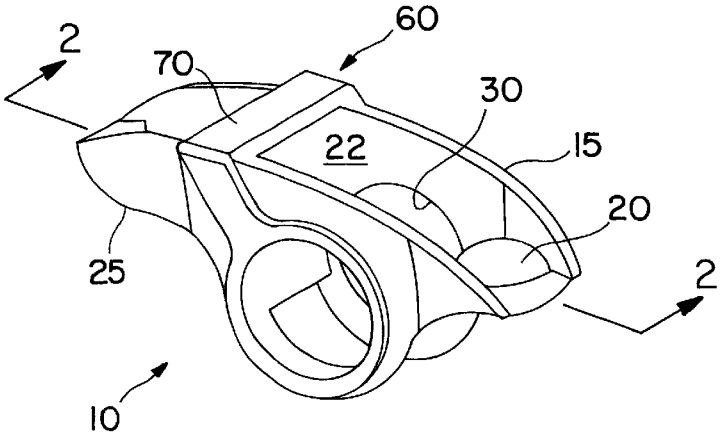
FIG. 1 is a perspective view of a stamped rocker arm assembly according to the invention.
Figure 2:
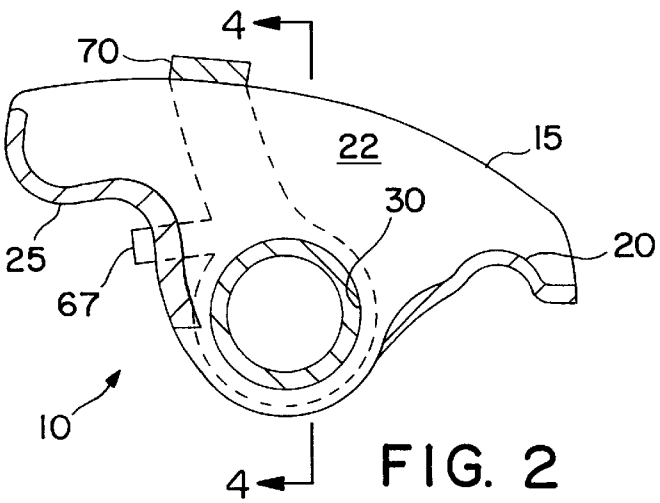
FIG. 2 is a longitudinal sectional view of the rocker arm assembly taken along line 2—2 of FIG. 1.
Figure 3C:
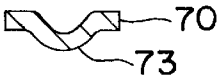
FIGS. 3*a,* 3*b,* and 3*c* are fragmentary perspective views of the stiffener strap of the invention illustrating three possible embodiments of a rocker arm lateral wall stabilizing feature.
Figure 3B:
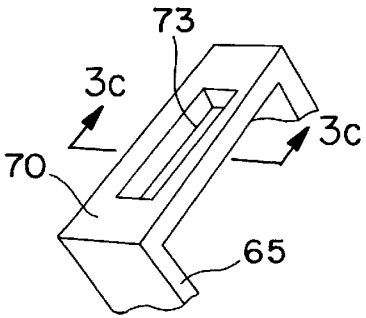
Figure 4:
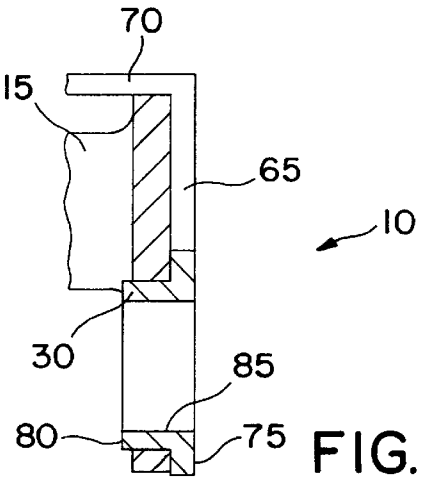
FIG. 4 is a fragmentary partially sectional view of the rocker arm assembly taken along line 4—4 of FIG. 2.
Figure 3A:
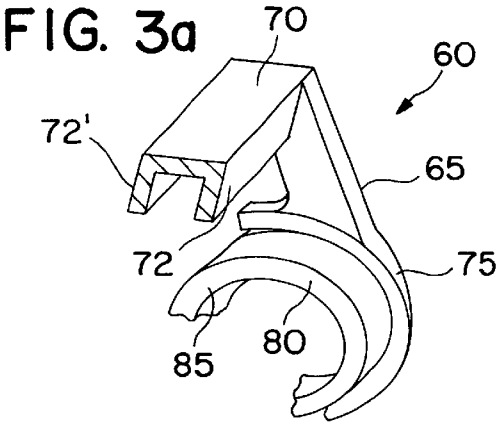

A stamped rocker arm assembly 10, according to the invention, is shown in FIGS. 1 and 2. It comprises a rocker arm body 15 and a stiffener strap 60. The rocker arm body 15 has a push rod socket 20 at one end, a valve pallet 25 at the other end, and two lateral walls 22 extending between the push rod socket and the valve pallet. Each wall 22 has a bearing support bore 30 aligned on a common pivot axis. A stiffener strap 60 (see also FIGS. 3*a,* 3*b,* and 3*c,* and 4) is provided to prevent buckling of the sidewalls 22 under load when in service. It has two bearing housings 75, each of which has a bore 85 in a projecting ring 80 which fits in a bearing support bore 30 in a lateral wall 22. The bearing housings 75 are formed at the ends of two legs 65 which depend from a tie bar 70 and extend along the sidewalls 22 of the rocker arm body 15. They may be formed in ends of the strap 60 which are locally thicker than the legs 65 and tiebar 70, or they may be extruded in ends of equal thickness to the rest of the stiffener strap 60. In either case, they provide the stable bearing support not obtained in previous stamped rocker arms.

These bearing housings 75 carry anti-friction bearings (not shown) which reduce friction between the rocker arm body 15 and the pivot body (not shown) and, thereby, improve efficiency of machines, such as internal combustion engines, in which the rocker arm assemblies 10 are used. The reinforcing function of the stiffener strap 60 is especially important, since it is easier to form thin gauge material in a press and since thin gauge material is lighter in weight than heavy gauge material. Not only does this reduce manufacturing difficulty, but it also reduces weight of the engine and improves efficiency. However, thin walls tend to buckle under compressive loading, so the stiffener strap 60 is used to provide axial support to the lateral sidewalls 22 of the rocker arm body 15. If the rocker arm body is formed with its lateral walls 22 bowed slightly outward, the stiffener strap need only provide support from the outside of the rocker arm body 15, since buckling would tend to occur only in the outward direction. If, however, the lateral walls 22 of the rocker arm body 15 are straight, then it is necessary to reinforce the sidewalls in both axial directions. This is done by providing at least one stabilizer tab 72 (FIG. 3*a*) on the tie bar 70. When assembled on the rocker arm body 15, tab 72 on the tie bar 70 clamps the sidewalls 22 firmly against the legs 65 of the stiffener strap 60. Thus, the sidewalls are constrained and cannot buckle in either direction. The stabilizer tab 72 is shown as a single full-width tab. It can also be formed as two separate tabs, each of which can individually clamp one sidewall 22 against one leg 65 of the stiffener strap. Another possible stabilizer tab arrangement could have two full-width tabs, the second of which is illustrated as 72' in FIG. 3*a*. Still another could provide a stamped ridge 73 in the tie bar 70 (FIGS. 3*b* and 3*c*) the edges of which act the same as stabilizer tabs 72 and 72' to clamp sidewalls 22 against the legs 65 of the stiffener strap 60. Other similar provisions for preventing buckling of the sidewalls 22 will be obvious from the examples given.

The stiffener strap 60 is secured against rotative displacement with respect to the rocker arm body 15 by one of several techniques. It may be tack welded, brazed, or mechanically keyed to the body. Of course, mechanical keying is preferred, since the mechanical keying features are easily provided during forming of the rocker arm body 15 and the stiffener strap 60, and they produce no heat affect on the material. One simple key is shown in FIG. 2, in which a tab 67 is seen to project from the leg 65 of the stiffener strap 60 and to lie against the edge of the rocker arm body 15. The tab 67, together with the tie bar 70, prevents relative rotation, about the pivot axis, between the rocker arm body and the stiffener strap.

The rocker arm assembly 10 of the invention provides reduced weight and capability for anti-frictionizing by use of anti-friction pivot bearings. Using the stiffener strap 60 to axially restrain the sidewalls 22 of the rocker arm body 15 against buckling under compressive loading in service, the invention allows stamping of the rocker arm body 15 from light gauge material (preferably steel). The stiffener strap not only reinforces the sidewalls 22, but it also provides bearing housings 75 for anti-friction bearings. These bearing housings are necessitated by the thin walls of the stamped rocker arm which do not provide sufficient bearing support area. The resulting rocker arm assembly has a low mass but still provides sufficient rigidity and bearing support area to ensure accurate valve operation and resistance to bearing walk or misalignment.

What is claimed is:

1. A rocker arm, for operating a reciprocating valve, comprising:

a stamped rocker arm body having a push rod socket at a first end, a valve pallet at a second end, and two lateral walls extending between said first and second ends, each of said lateral walls having a bearing support aligned on a common axis; and a stiffener strap extending from one bearing support of over one of the two lateral walls said lateral walls to the bearing support of the other of the two lateral walls, said stiffener strap having a bearing housing at each end for engagement with said bearing supports.

2. The rocker arm of claim 1, wherein said stiffener strap has means for preventing buckling of the lateral walls of said stamped body in both inward and outward directions.

3. The rocker arm of claim 1, wherein said rocker arm body is stamped from steel.

* * * * *